US007528334B2

(12) United States Patent
Beyrard et al.

(10) Patent No.: US 7,528,334 B2
(45) Date of Patent: May 5, 2009

(54) CIRCUIT BREAKER-CONTACTOR WITH A PIEZO-ELECTRIC CONTROLLED LOCKING

(75) Inventors: Norbert Beyrard, 710, avenue des Thermes, Divonne-les-Bains (FR) F-01220; Frank Claeyssen, Meylan (FR); Ronan Le Letty, Grenoble (FR); Francois Barillot, Le Versoud (FR)

(73) Assignee: Norbert Beyrard, Divonne-les-Bains (FR)

( * ) Notice: Subject to any disclaimer, the term of this patent is extended or adjusted under 35 U.S.C. 154(b) by 27 days.

(21) Appl. No.: 11/873,897

(22) Filed: Oct. 17, 2007

(65) Prior Publication Data

US 2008/0179170 A1 Jul. 31, 2008

Related U.S. Application Data

(63) Continuation of application No. PCT/EP2006/003704, filed on Apr. 21, 2006.

(30) Foreign Application Priority Data

Apr. 22, 2005 (FR) ..... 05 04141

(51) Int. Cl.
*H01H 1/52* (2006.01)
*H01H 3/20* (2006.01)

(52) U.S. Cl. ..... 200/318; 200/181; 337/12; 361/42; 335/78; 310/328

(58) Field of Classification Search ..... 200/181, 200/318; 337/12–13, 36–38; 361/42–50; 335/78, 47; 310/328, 330, 332
See application file for complete search history.

(56) References Cited

U.S. PATENT DOCUMENTS

| | | | | |
|---|---|---|---|---|
| 4,473,859 | A * | 9/1984 | Stone et al. | 361/99 |
| 5,430,597 | A * | 7/1995 | Bagepalli et al. | 361/102 |
| 5,859,579 | A * | 1/1999 | Branston et al. | 337/116 |
| 6,323,581 | B1 | 11/2001 | Powell | |
| 2002/0149462 | A1 | 10/2002 | Habedank | |

FOREIGN PATENT DOCUMENTS

| | | |
|---|---|---|
| EP | 0058322 | 10/1986 |
| EP | 1241698 | 9/2002 |
| WO | 2005024879 | 3/2005 |

* cited by examiner

*Primary Examiner*—Kyung Lee
(74) *Attorney, Agent, or Firm*—Sturm & Fix LLP

(57) ABSTRACT

The inventive circuit breaker-contactor (1) comprises a fixed contact, a contact (5) movable (19, 21) with respect to the fixed contact between open and closed positions, means (7) for displacing the movable contact (5) in the closed position thereof, means (9) for displacing the movable contact in the open position. According to said invention, said circuit breaker-contactor comprises means (11) for locking the movable contact (5) in the closed position thereof, a piezo-electric actuator (13) deformable from a rest position to an operating position for displacing the locking means (11) in such a way that the movable contact (5) is enabled to be displaced to the open position by the means (9) for displacing to the open position and an electronic power supply and control unit (15) for feeding and controlling the piezo-electric actuator (13) deformation in the operating position for displacing the locking means (11) in such a way that the movable contact (5) is unlocked in response to an electric current detected by the fixed contact (1).

5 Claims, 7 Drawing Sheets

CIRCUIT BREAKER-CONTACTOR WITH A PIEZO-ELECTRIC CONTROLLED LOCKING

CROSS REFERENCE TO RELATED APPLICATIONS

This application is a Continuation application of PCT/EP2006/003704 filed Apr. 21, 2006, claiming priority of FR0504141 filed Apr. 22, 2005, which are incorporated by reference herein in their entirety.

BACKGROUND OF THE INVENTION

1. Field of the Invention

The invention concerns a circuit breaker-contactor comprising more specifically one or two fixed contacts, a contact movable relative to the fixed contacts between a closed position and an open position, a means for displacing the movable contact into the closed position, and a means for displacing the movable contact into the open position.

2. Description of the Related Art

A circuit breaker-contactor of this type is known in particular from document EP-A-1 058322. The means for displacing the movable contact into the closed position is a piezoelectric actuator. Under the effect of a fault detected in the main circuit on which the circuit breaker-contactor is disposed, an electronic control unit acts on the piezoelectric actuator to trigger the opening of the contacts at a precise moment, for example at the moment when the amperage or the voltage in the main circuit passes through a point of zero amperage or voltage, called zero point.

In this circuit breaker-contactor, the piezoelectric actuator maintains the movable contact in the closed position for as long as the circuit breaker-contactor is closed. It has been noted that in order to obtain a rapid break when the contact pressure between the fixed contacts and the movable contact is high, a powerful piezoelectric actuator, i.e. one which is still relatively expensive at present, is necessary.

One of the aims of the invention is to devise a circuit breaker-contactor which remedies this disadvantage.

SUMMARY OF THE INVENTION

To that end, the subject of the invention is a circuit breaker-contactor comprising one or two fixed contacts, a contact movable relative to the fixed contacts between a closed position and an open position, a means for displacing the movable contact into the closed position, a means for displacing the movable contact into the open position, and also a means for locking the movable contact in the closed position, a piezoelectric actuator deforming from a rest position to an operating position in order to displace the locking means so that the movable contact can be displaced in the open position by the means for displacement to the open position, and an electronic power supply and control unit supplying power to and controlling the deformation of the piezoelectric actuator into the operating position in order to displace the locking means until the movable contact is unlocked, in response to an electric amperage detected in the fixed contact or contacts.

The idea is to cause the main circuit to open by releasing the potential energy of a powerful resilient means, for example a spring, through displacement of the means for locking the movable contact. The potential energy of the spring has been accumulated during the displacement of the movable contact into the closed position. The release of this potential energy causes the circuit breaker-contactor to open extremely rapidly.

The locking means is for example a catch or a trigger. It may be incorporated into the piezoelectric actuator so that the latter acts directly on the movable contact. Preferably, the locking means is not incorporated into the piezoelectric actuator but is designed in the form of a lever in order to amplify the deformation of the piezoelectric actuator.

Experience has shown that after approximately two milliseconds, the main circuit is sufficiently open and that the reaction time of the piezoelectric actuator is also approximately two milliseconds. Thus the electronic control unit may operate so that the circuit breaker-contactor is able to open very precisely at a moment when, for example, the amperage is close to zero, without producing an arc or spark which might adversely affect the life of the circuit breaker-contactor and the operation of the electrical systems disposed downstream or upstream.

Other advantages will appear in the light of the description of two embodiments of the invention shown in the drawings.

DETAILED DESCRIPTION OF THE PREFERRED EMBODIMENT

Figure 1:
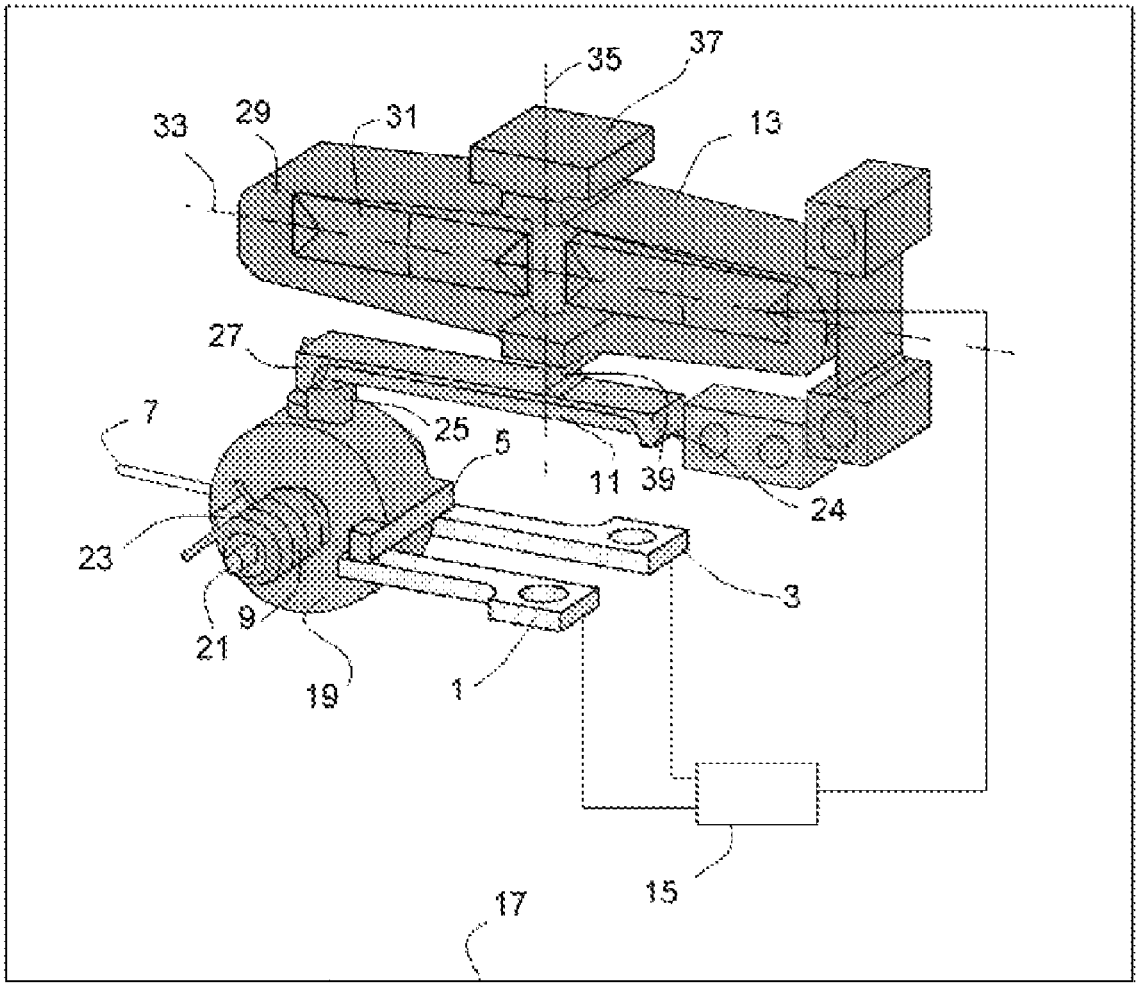
FIG. 1 is a perspective view of a circuit breaker-contactor according to a first embodiment of the invention.

With reference to FIG. 1, a circuit breaker-contactor includes two contacts 1, 3 fixed relative to one another, a contact 5 movable relative to the fixed contacts 1, 3 between a closed position and an open position, and a means 7 for displacing the movable contact 5 into the closed position.

The circuit breaker-contactor also includes a means 11 for locking the movable contact 5 into the closed position, a piezoelectric actuator 13 deforming in order to displace the locking means 11 until the movable contact 5 is unlocked and to allow it to be displaced into the open position, and an electronic control unit 15 controlling the deformation of the piezoelectric actuator 13 in response to an electric amperage detected in the fixed contacts 1, 3.

The set of elements described above is disposed in a small housing of insulating material, represented diagrammatically in FIG. 1 by the item numbered 17. The dimensions of the housing are, for example, as follows: length 65 mm, depth 30 mm, height 55 mm. In particular, the contacts 1 and 3 are fixed relative to the housing 17.

The movable contact 5 is carried by a carrier arm 19 rotationally mounted around an axis 21. A spring 9 is disposed on either side of the carrier arm 19 around the axis 21. It rests against a stop 23 of the carrier arm 19 so that it is deformed by torsion around the axis 21 when the carrier arm 19 is displaced in rotation by the operating lever 7 serving as a manual means for displacement.

The locking means 11 takes the form of a lever arm and acts via a catch 27 on a locking nose 25 fixed to the carrier arm 19 in order to lock the movable contact 5 in the closed position. In the position of engagement with the locking nose 25, the catch 27 takes up the force exerted by the springs 9 deformed by torsion around the axis 21.

In the embodiment illustrated in FIG. 1, the piezoelectric actuator 13 includes a frame in the form of an ellipse 29 within which the piezoelectric elements 31 are disposed. Through a piezoelectric effect, the major axis 33 of the ellipse is lengthened whilst the minor axis 35 is shortened relative to a rest position. In this operating position, the piezoelectric actuator 13 raises the lever arm 11, joined to the frame 29 of the piezoelectric actuator 13 by an attachment point 39 disposed along the minor axis 35. A weight 37 is provided opposite the attachment point 39 disposed along the minor axis 35 in order to create a free resonance condition at a resonance frequency of approximately 1000 Hz.

To open the circuit breaker-contactor, the piezoelectric actuator 13 is deformed during a very short period of time in order to displace the lever arm 11 mounted so that it pivots relative to the housing 17 around a link 24 fixed relative to the housing 17. The lever arm enables the deformation of the piezoelectric actuator 13 to be amplified. The piezoelectric actuator 13 thus raises the catch 27 above the locking nose 25 until it unlocks the rotation of the carrier arm 19 under the effect of the force stored by the torsion springs 9. The movable contact 5 is driven in rotation by the carrier arm 19 in order to open the circuit breaker-contactor.

In this first embodiment, the piezoelectric actuator 13 acts only to release the locking, that is, to displace the locking means 11 until the movable contact 5 is unlocked from the closed position under the effect of the force stored by the resilient means 9. The circuit breaker-contactor is closed by the operating lever 7 so that it displaces the carrier arm 19 and at the same time causes the movable contact 5 to lock in the closed position. In other words, in order to reset the circuit breaker-contactor, the catch 27 is displaced by the locking nose 25 until it engages the latter. During this displacement, the deflection of the lever arm between the catch 27 and the attachment point 39 is exploited, whilst the piezoelectric actuator 13 is in the rest position.

Figure 2:
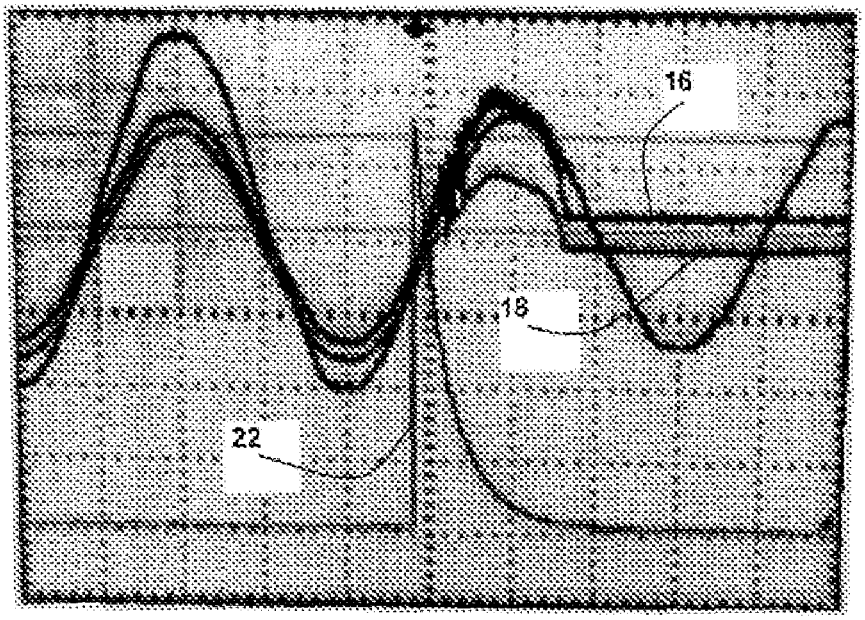
FIG. 2 shows an oscillogram illustrating the breaking at zero point of the circuit breaker-contactor shown in FIG. 1.

It has been noted experimentally that such a circuit breaker-contactor, from the point of view of the break, performs to a high standard, since it allows breaking at zero point, this being illustrated by the oscillogram shown in FIG. 2, obtained during testing. In fact, this photograph shows that the amperage 16 and the voltage 18 cancel each other out at zero point, under the effect of a fault 22 triggered at the immediately preceding zero point.

The point to be borne in mind is that the 3 mm distance of the movable contact 5 from the fixed contacts 1, 3 after 2.5 milliseconds is generally sufficient to stop an arc or a spark for voltages of 220 to 230 volts. The periods of time for release of the catch 27 are 0.5 milliseconds and the period of time for loss of contact is 0.8 milliseconds. In all, between the pulse given ten milliseconds before zero point, a delay of about 6 to 8 milliseconds following the order is sufficient to lead to the main circuit opening at a proper moment.

The speed with which the circuit break takes place is an important safety factor in the operation of the circuit breaker-contactor and in the role which it plays in protecting the circuits supplied with power through it.

Figure 3:
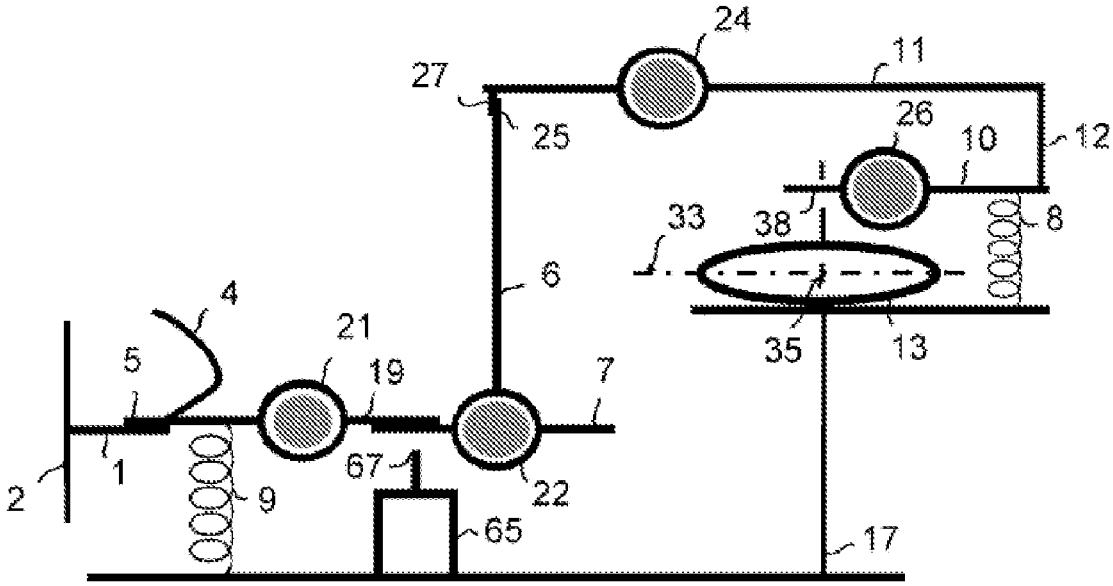
FIG. 3 is a diagrammatic view of a circuit breaker-contactor according to a second embodiment, in the closed position.
Figure 4:
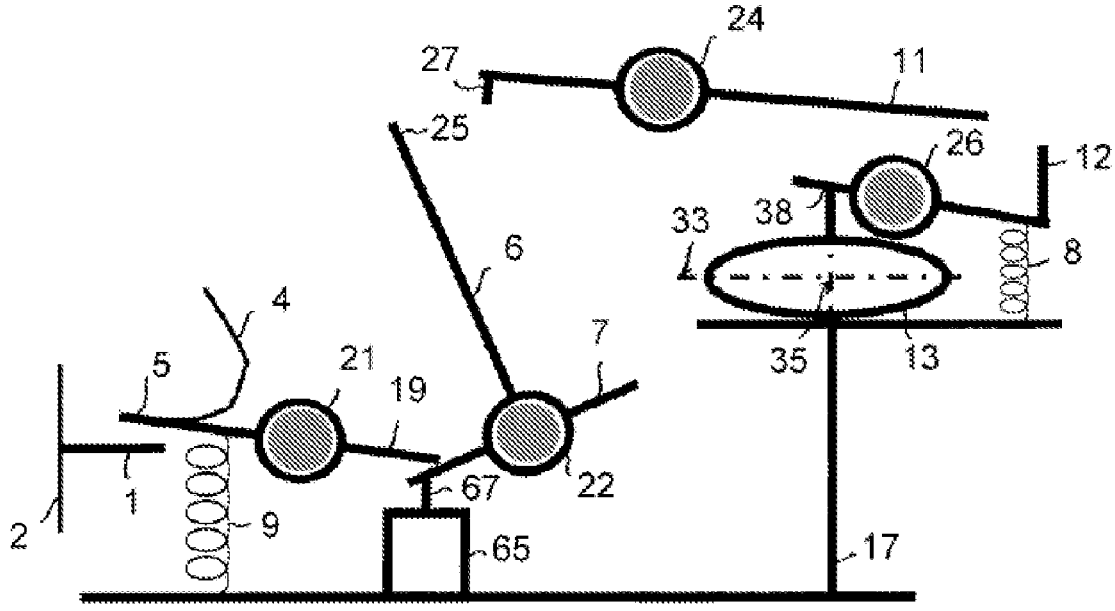
FIG. 4 is a diagrammatic view of the circuit breaker-contactor according to the second embodiment, in the open position.

FIGS. 3 and 4 show a second embodiment of the invention. The elements common to both embodiments retain the same reference number.

The circuit breaker-contactor is connected to the main current circuit by a line 2 connected to the fixed contact 1 and by a flexible cable 4 connected to the movable contact 5.

Unlike the first embodiment, the means for displacement 7 moves with a first intermediate lever arm 6 between the carrier arm 19 and the locking means 11. The catch 25 is no longer fixed to the carrier arm 19 but to this intermediate lever arm 6 movable around a rotational axis 22 fixed relative to the housing 17. The locking means 11 is a lever arm pivotably mounted around a rotational axis 24 fixed relative to the housing 17. The spring 9 is joined to the movable contact 5 by being fixed to the carrier arm 19 by one extremity and to the housing 17 by an opposite extremity so that it deforms by elongation. The piezoelectric actuator 13 is connected to the locking means 11 by a second intermediate lever arm 10, rotationally mounted around a rotational axis 26 and joined to the piezoelectric actuator 13 by an attachment point 38. A transmission arm 12 connects the locking means 11 to the second intermediate arm 10.

In FIG. 3, the circuit breaker-contactor is in the closed position. Via the engagement between the locking nose 27 carried by the locking means 11 and the catch 25 carried by the intermediate lever arm 6, the locking means 11 locks the rotation of the arm 19 carrying the movable contact 5 around the rotational axis 21. A spring 8 is fixed to the second intermediate arm 10 by one extremity and to the housing 17 by an opposite extremity to hold the locking means in the locking position. The piezoelectric actuator 13 is in the rest position.

In FIG. 4, the circuit breaker-contactor is in the open position. In order to open, the piezoelectric actuator 13 deforms for a very short period of time in the operating position, extending the minor axis 35 of the elliptical frame 29 and shortening the major axis 33. This results in a pivoting movement of the second intermediate lever arm 10 around the rotational axis 26, which movement causes the locking means 11 to pivot around the rotational axis 24 so that the catch 27 is raised above the locking nose 25. During these displacements, the second spring 8, joined to the intermediate lever arm 10, is compressed. The unlocking of the catch 27 releases the first intermediate lever arm 6 in rotation around the rotational axis 22 and releases the carrier arm 19 in rotation around the rotational axis 21, under the effect of the relaxation of the spring 9 joined to the arm 19 carrying the movable contact 5.

In order to reset the circuit breaker-contactor in the closed position, manual operation of the displacement means 7 is required to displace the first intermediate arm 6 around the rotational axis 22. During this displacement, the spring 9, joined to the arm 19 carrying the movable contact 5, is compressed. The piezoelectric actuator 13, which was returned to the rest position, is once again deformed for a very short period of time into the operating position. The result of this is a rotational displacement of the second intermediate arm 10 around the rotational axis 26, which causes the locking means 11 to pivot around the rotational axis 24 so that it once again raises the catch 27 above the locking nose 25. During these displacements, the second spring 8, joined to the intermediate lever arm 10, is compressed. When the piezoelectric actuator 13 returns to the rest position, the spring 8 relaxes causing the rotation in the opposite direction of both the intermediate arm 10 around the rotational axis 26 and the lever arm 11 around the rotational axis 24, until the catch 27 once again engages the locking nose 25 to lock the movable contact 5 in the closed position.

In the first embodiment, the piezoelectric actuator 13 is used only to raise the locking means 11 when the circuit breaker-contactor is opened. In the open state, the piezoelectric actuator, being no longer supplied with power, returns to its rest position. To reset the circuit breaker-contactor, the deflection of the lever arm between the catch 27 and the attachment point 39 is exploited, as previously mentioned.

In the second embodiment, the piezoelectric actuator 13 is likewise used to raise the locking means 11 during the opening of the circuit breaker-contactor. Here again, in the open state, the piezoelectric actuator 13 returns to its rest position. However, to reset the circuit breaker-contactor, it is necessary to deform it once again into its operating position in order to raise the locking means 11 again for a period of time necessary to allow the second intermediate arm 6 to pass below the catch 27.

An examination of the conditions in which the unlock order takes place now follows.

Figure 5:
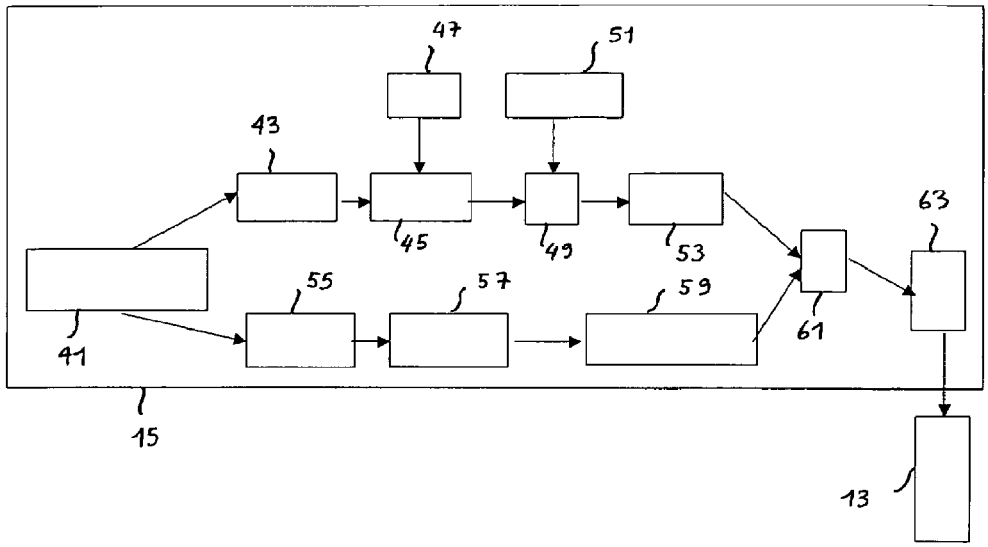
FIG. 5 is a diagram of an electronic control of the circuit breaker-contactor.

The control of zero point breaking is implemented by an electronic circuit whose logic is shown in FIG. 5. This control is described in the European patent cited in the introduction. It includes:

- a means 41, consisting for example of an induction loop, for measuring the amperage or the voltage of the current in the circuit on which the circuit breaker-contactor is installed.
- two electronic hook-ups supplied by this means for measuring:

The first electronic hook-up consists of the following sequence:

- a current rectifier 43;
- a comparator 45 enabling the instantaneous amperage to be compared with a threshold level adjustable, for example, by a potentiometer 47. This comparator may be complemented in order to take account of a drop in voltage, a mass defect, or a balance error in the current upstream and downstream of the contacts.
- in 49, a logical OR operation making it possible to introduce either an immediate order or a order originating from a delay means 51, for example a bimetal timer or an analogue circuit operating as a bimetal timer.
- a memory 53 supplied with the fault noted during the previous stages.

The second parallel hook-up consists of the following sequence:

- a filter means 55 to eliminate faults such as electrical noise;
- a zero crossing detector 57;
- a delay means 59 making it possible to delay the triggering of the circuit breaker until a delay point. The delay is adjusted to take account of the activation time of the piezoelectric actuator and the time for displacement of the movable contact beyond a certain distance from the fixed contact or contacts. In other words, if account is taken of the fact that the activation time of the piezoelectric actuator 13 is two milliseconds and that the time for displacement of the movable contact 5 beyond an opening distance of 1 millimetre relative to the fixed contact 1 is three milliseconds, the command to open has to be delayed by five milliseconds in order to trigger the opening ten milliseconds after the immediately preceding zero point. These ten milliseconds correspond to a half-period of an alternating current of a frequency equal to 50 Hertz. Consequently, the control unit 15 triggers the opening of the circuit breaker-contactor exactly at zero point.

The two electronic hook-ups are connected at 61 to an AND logic circuit. The passing signal is thus adjusted and amplified at 63. This signal thus controls the piezoelectric actuator 13 for opening the circuit breaker-contactor. This control may be supplemented by the following signals or controls:

- a functional signal indicating that the circuit is closed and/or that the current is flowing through the contacts;
- a fault signal in the event of overcurrent or any other fault likely to activate the circuit breaker;
- a signal indicating that the contacts are open.

The unlocking is thus controlled electronically so that it causes triggering of the piezoelectric actuator and opening of the circuit breaker-contactor. Thus, the opening of the circuit breaker-contactor takes place under the following two conditions:

- the existence of a fault detected and stored in memory by the first electronic hook-up, and
- a command to open the circuit breaker-contactor using the second electronic hook-up so that opening takes place when the amperage or voltage of the alternating current is zero, that is, it passes through the zero point.

In the embodiments described above, the closure of the circuit breaker-contactor is effected manually by means of the operating lever 7. However, the closure may also be controlled electrically by a second piezoelectric actuator or by an electromagnetic actuator, consisting for example of an electromagnet operating only during the closure phase, in such a way that, with the circuit breaker-contactor closed, the energy consumption is nil.

For high current intensities, it is also possible to operate using pneumatic or hydraulic pressure or by using vapour pressure contained in a chamber, just as the spring 9 acting during the opening of the circuit breaker-contactor may be replaced by other such similar systems.

In FIG. 4, a solenoid 65 operates on the means 7 for displacement of the arm 19 carrying the movable contact 5 so as to enable the circuit breaker-contactor to close, through the translation of a movable rod 67. In FIG. 3, the solenoid 65 is returned to a rest position.

It is understood that, according to the invention, it is possible to utilise, simultaneously or otherwise, means for displacement of the openably movable contact which operate hydraulically, pneumatically or by vapour pressure, and which can be substituted for the spring 9. These means for displacement are controlled by the electronic control unit 15 and their control is coordinated with the control of the piezoelectric actuator 13 displacing the locking means 11 until the movable contact 5 is unlocked.

Figure 6:
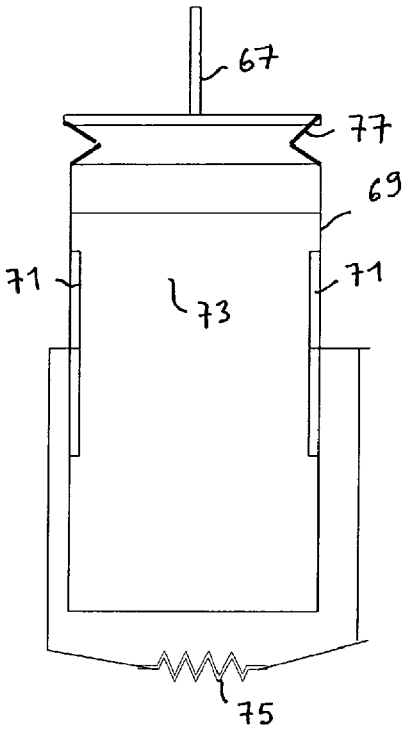
FIG. 6 shows a means for displacement using liquid vapour pressure, in the rest position.
Figure 7:
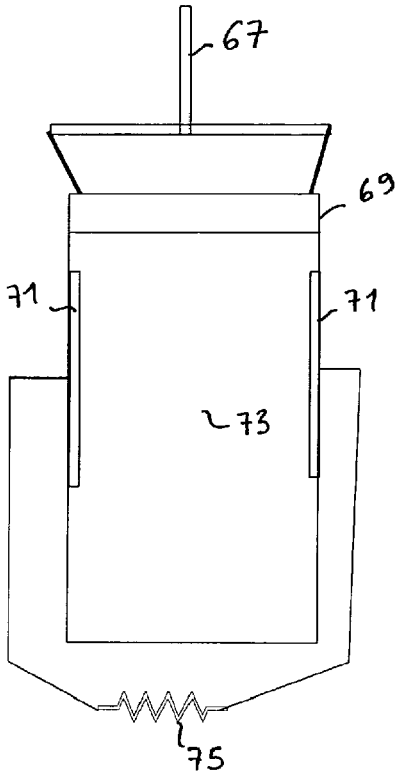
FIG. 7 shows the means for displacement using liquid vapour pressure, in the operating position.

A means for displacement using vapour pressure is described diagrammatically in FIGS. 6 and 7. The control means includes a closed chamber 69 containing two electrodes 71 and a conducting liquid 73 capable of vaporising when the electrodes 71 are supplied with electrical power 75. It operates as follows:

- on the left, in FIG. 6, in the absence of vapour, an expandable bellows 77 is in the low position;
- on the right, in FIG. 7, when vapour is produced by heating due to a flow of current, the bellows 77 is in the high position and its movement caused the displacement of a rod 67 acting on the means for displacement 7 of the arm 19 carrying the movable contact 5.

Figure 8:
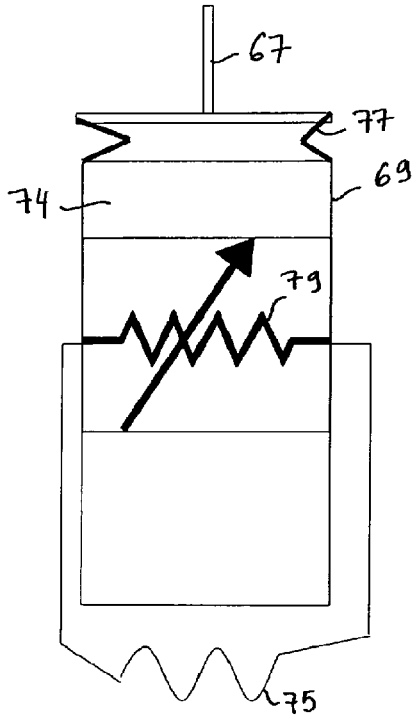
FIG. 8 shows a means for displacement using gas pressure, in the rest position.
Figure 9:
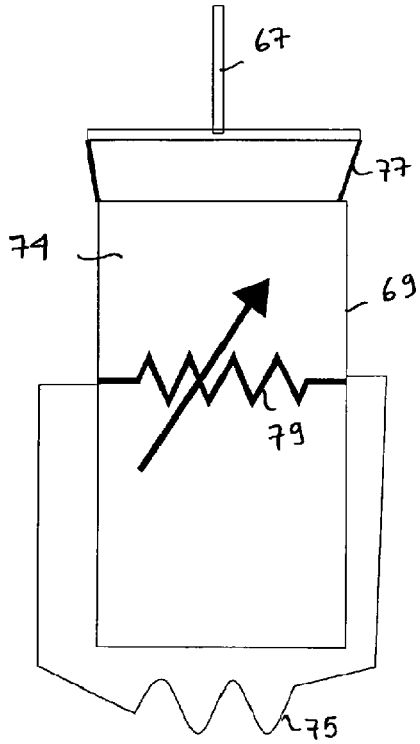
FIG. 9 shows the means for displacement using gas pressure, in the operating position.

In such a chamber, in FIGS. 8 and 9, the water may be replaced by a gas 74 which, under the effect of heating, produced for example by an electrical resistor 79, causes displacement of the bellows 77, which in its turn acts to cause closure of the contacts instead of the solenoid as described with reference to the previous FIGS. 6 and 7.

Such control means are bistable and under these conditions, if the power supply to the solenoid or the control means which may be substituted for it is cut when its action is complete, the energy consumption is nil outside the periods of operation.

The triggering may be effected at any point in time if the pressure of the contacts is such that contact bounce is very limited. Provision is made for temporal coordination of the action of the solenoid 65 operating on the means for displacing the arm 19 carrying the movable contact 5 at the time of closure, and of the action of the piezoelectric actuator 13 to enable the locking nose to pass below the catch 27. Advantageously, the closing or the opening of the circuit breaker-contactor may be controlled remotely by any manual or automatic means.

It should be noted that all the methods of operation of the circuit breaker-contactor have been designed to enable the piezoelectric or other actuators to operate only very briefly during the opening or closing of the circuit breaker-contactor.

A circuit breaker-contactor according to the invention may be miniaturised, which enables it to use for example one piezoelectric actuator for closing and another for opening and permits it to operate very rapidly and thus at higher frequencies. The circuit breaker contactor is thus able to control the sequences of operation of X-ray or laser beams used in particular in medical scanners, such as those described in patent applications FR 04.06497 and FR 04.52677.

The invention claimed is:

1. Circuit breaker-contactor including:

one or two fixed contacts;

a contact movable relative to the fixed contacts between an open position and a closed position;

a means for displacing the movable contact into the closed position;

a means for displacing the movable contact into the open position;

a means for locking the movable contact into the closed position.

a piezoelectric actuator deforming from a rest position to an operating position in order to displace the locking means so that the movable contact can be displaced into the open position by the means for openable displacement;

and an electronic power supply and control unit supplying power to and controlling the deformation of the piezoelectric actuator into the operating position in response to an electrical amperage detected in the fixed contact or contacts wherein the locking means is a lever pivoting around a fixed axis, provided with a catch to lock the movable contact by absorbing a potential energy stored by the means for openable displacement and connected to the piezoelectric actuator by an attachment point so as to be pivotably controlled by the piezoelectric actuator in order to displace the catch until the movable contact is unlocked by releasing the potential energy stored by the means for openable displacement.

2. Circuit breaker-contactor according to claim 1, in which the lever arm deforms by deflecting so that it locks the movable contact in the closed position.

3. Circuit breaker-contactor according to claim 1, in which the means for displacing the movable contact for opening is a spring, a piezoelectric actuator or a means having an electromechanical, hydraulic, pneumatic, liquid vapour pressure or gas vapour pressure action controlled by the electronic control unit.

4. Circuit breaker-contactor according to claim 3, in which the spring deforms by torsion or by elongation.

5. Circuit breaker-contactor according to claim 1, in which the means for closing the movable contact includes a piezoelectric actuator, or a means whose action is electromechanical, hydraulic, pneumatic or uses liquid vapour pressure or gas vapour pressure controlled by the electronic control unit.

* * * * *